US006253961B1

(12) United States Patent
Anderson et al.

(10) Patent No.: US 6,253,961 B1
(45) **Date of Patent: *Jul. 3, 2001**

(54) FLUID DISPENSER APPARATUS

(75) Inventors: Mark L. Anderson, 303 S. MacKay Ave., Spring Valley, WI (US) 54767; Hugh R. Dent, Corsley (GB)

(73) Assignee: Mark L. Anderson, Spring Valley, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/304,297

(22) Filed: May 3, 1999

Related U.S. Application Data

(63) Continuation-in-part of application No. 08/870,918, filed on Jun. 6, 1997.

(51) Int. Cl.[7] ..... B67D 5/00

(52) U.S. Cl. ..... 222/83; 222/321.7; 222/309; 604/183

(58) Field of Search ..... 222/321.6, 321.7, 222/183, 131, 83, 192, 324, 309, 383.3, 43; 604/183

(56) References Cited

U.S. PATENT DOCUMENTS

| | | | | |
|---|---|---|---|---|
| D. 287,211 | * | 12/1986 | Weiss | D7/76 |
| 1,496,126 | * | 6/1924 | Livingstone | 604/183 |
| 2,086,467 | * | 7/1937 | Bryan | 222/82 |
| 2,172,521 | * | 9/1939 | Shoner | 221/102 |
| 2,753,079 | * | 7/1956 | Hersey | 222/324 |
| 2,825,334 | * | 3/1958 | Kas, Sr. | 604/183 |
| 3,209,951 | * | 10/1965 | Greene et al. | 222/82 |
| 3,215,171 | * | 11/1965 | Mitchell | 222/192 |
| 3,228,564 | * | 1/1966 | Olson | 222/82 |
| 3,526,225 | * | 9/1970 | Isobe | 604/183 |
| 3,604,592 | * | 9/1971 | Bacon et al. | 222/192 |
| 3,827,601 | * | 8/1974 | Magrath et al. | 222/83 |
| 3,952,918 | * | 4/1976 | Poitras et al. | 222/82 |
| 3,952,919 | * | 4/1976 | Hansen et al. | 604/183 |
| 4,185,755 | * | 1/1980 | Sachs et al. | 222/43 |
| 4,564,360 | * | 1/1986 | Young et al. | 604/183 |
| 4,678,107 | | 7/1987 | Ennis, III . | |
| 4,826,050 | | 5/1989 | Murphy et al. . | |
| 4,852,772 | | 8/1989 | Ennis, III . | |
| 4,871,092 | * | 10/1989 | Maerte | 222/153 |
| 4,923,096 | | 5/1990 | Ennis, III . | |
| 4,923,448 | | 5/1990 | Ennis, III . | |
| 4,981,472 | | 1/1991 | Ennis, III et al. . | |
| 4,995,867 | | 2/1991 | Zollinger . | |
| 5,176,645 | | 1/1993 | Guerrero . | |
| 5,188,610 | * | 2/1993 | Rains | 604/183 |
| 5,190,191 | | 3/1993 | Reyman | 222/256 |
| 5,217,442 | * | 6/1993 | Davis | 604/218 |

(List continued on next page.)

*Primary Examiner*—Joseph A. Kaufman
*Assistant Examiner*—Melvin A. Cartagena
(74) *Attorney, Agent, or Firm*—Skinner and Associates

(57) ABSTRACT

A fluid dispenser used to administer fixed or adjustable doses of fluids in oral, intranasal, or injectable applications. The dispenser may be used to draw off fluid from a flexible or rigid bulk container or to draw fluid from a mounted flexible or rigid container such as a sealed-end bag or bottle, or a threaded bag or bottle. The fluid dispenser generally comprises: a connection member communicatively connected to a fluid source container; a body member having a dose cylinder communicatively connected to the connection member; a piston member operationally related to the dose cylinder and spring biased in an extended position; and a trigger member attached to the piston member and communicatively connected to the dose cylinder through the piston member. The dispenser may include an automatic venting feature to assist with the smooth, easy flow of fluid during an application and to prevent contaminants from being suctioned back into the container. The dispenser may also include a dispensing mechanism for dispensing measured doses, a protective cap, insulation and padding.

31 Claims, 11 Drawing Sheets

U.S. PATENT DOCUMENTS

| | | | | |
|---|---|---|---|---|
| 5,344,409 | | 9/1994 | Ennis, III et al. . | |
| 5,413,255 | | 5/1995 | Dent . | |
| 5,435,462 | | 7/1995 | Fujii . | |
| 5,482,095 | * | 1/1996 | De Chollet | 222/192 |
| 5,553,750 | * | 9/1996 | Foster | 222/179.5 |
| 5,600,958 | * | 2/1997 | Henning et al. | 62/60 |
| 5,695,090 | * | 12/1997 | Burdick | 220/739 |
| 5,816,453 | * | 10/1998 | Spencer et al. | 222/321.3 |
| 5,934,510 | * | 8/1999 | Anderson | 222/83 |

* cited by examiner

FLUID DISPENSER APPARATUS

CROSS-REFERENCE TO RELATED APPLICATIONS, IF ANY

This application is a continuation-in-part of application Ser. No. 08/870,918, filed Jun. 6, 1997, status pending.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to apparatus and methods for delivering fluids. More particularly, the invention relates to dispensers used to administer medicine. It has an optimal use in delivering multiple doses of various fluids in oral, intranasal, or injectable applications. However, the invention also may have utility in other applications.

2. Background Information

The state of the art includes various devices and methods for dispensing fluids from containers, including pump bottles, spray cans and spray guns. Fluids such as drugs, nutritional supplements and the like have been dispensed to livestock using pop bottles or similar containers, syringes and gas powered gun-type devices for delivering liquid from bulk containers, and have been dispensed to humans using syringes, spoons, cups, and intravenous dosing.

The gun-type devices provide methods for drawing and delivering liquid for oral, hypodermic and topical applications using compressed gas. Therefore they need to be attached to compressed air lines or carry their own pressurized propellant. Although these gun-type devices can deliver adjustable and repeatable doses automatically, they are they are relatively complex and expensive. Furthermore, their mobility is hampered because they require a pressurized gas source. These gun-type devices are generally shown in the following art: Guerrero (U.S. Pat. No. 5,176,645) which describes a pneumatic modular device for dispensing medicine to animals; Murphy et al. (U.S. Pat. No. 4,826,050) which describes a spraying and dosing apparatus used to dispense liquid herbicides and insecticides; and Dent (U.S. Pat. No. 5,413,255) which describes improvements in gas powered applicators for dispensing measured doses of a liquid.

The syringe type devices provide a generally simpler method of dispensing doses. However, they generally require the user to repeatably and manually draw and then dispense the desired doses. Syringe type devices are generally shown in the following art: Ennis, III (U.S. Pat. No. 4,923,096) which describes a dripless automatic syringe for dispensing fluids; Ennis, III (U.S. Pat. No. 5,344,409) which describes a syringe latch; Ennis, III (U.S. Pat. No. 4,852,772) which describes a dispenser for viscous fluids; Ennis, III (U.S. Pat. No. 4,678,107) which describes a dripless dispenser for liquids and viscous fluids; and Ennis, III (U.S. Pat. No. 4,981,472) which describes a cannula assembly for a syringe.

Known devices and methods are believed to have certain limitations in certain cases, including the inability to dispense accurate doses, to accurately place or inject the doses, to function automatically and quickly, to be efficiently and easily used, maintained and cleaned, to function with various container types, and to be disposable.

Applicant's invention provides a dispenser which overcomes the limitations of the known art. It has an ergonomic design, automatic features, and an ability to accurately dispense accurate doses drawn from a variety of fluid containers. The dispenser can be easily lubricated, cleaned and disinfected. However, the dispenser is also relatively inexpensive, thus making it semi-disposable as warranted by the circumstances.

BRIEF SUMMARY OF THE INVENTION

The present invention provides a fluid dispenser which generally comprises: (1) a connection member having a fluid ingress channel; (2) a body member having a fluid communication channel, a dose cylinder of a predetermined volume, and a dose valve; (3) a piston member having a piston head positioned in the dose cylinder, a distal end, a piston rod connecting the distal end to the piston head, a piston valve, and a fluid egress channel; and (4) a trigger member fixedly connected to the distal end of the piston member.

In operation, an unprimed dispenser contains air in the fluid ingress channel, the fluid communication channel, the dose cylinder, the fluid egress channel and the trigger member. Squeezing the trigger member compresses the piston member and expels the air from the dose cylinder. Releasing the trigger member allows the piston member to undergo an expansion stroke which draws fluid into the fluid ingress channel, the fluid communication channel, and the dose cylinder. The dispenser becomes primed after about two compression and expansion cycles when the dispenser contains fluid in all of its channels and cylinders. A primed fluid dispenser draws the dose or predetermined volume of fluid into the dose cylinder during the expansion stroke of the piston member. The fluid is drawn through the fluid ingress channel and the communication channel. The dose of fluid is expelled from the dose cylinder through the fluid egress channel, the piston valve, and the trigger member during a compression stroke. The dose volume is determined by the predetermined dimensions of the dose cylinder and the predetermined displacement volume of the piston member. The dose volume may either be fixed or adjustable. Different volumes can be attained by replacing the piston member with another having a different configuration, by placing different sized blocks within the dose cylinder, or by using an adjustable dispensing mechanism.

In a first "Draw Off" embodiment, the dispenser further includes a mechanism for drawing off or suctioning fluid from a flexible or rigid fluid source container. A fluid stem containing the fluid ingress channel forms part of the connection member and is constructed to receive a hose. The hose connects the fluid source container to the fluid ingress channel. In a second "Threaded Bottle Mount" embodiment, the connection member has an inverted bottle cap form including internally threaded side walls. A flexible or rigid fluid source container with a threaded neck can be screwed onto the connection member so that the fluid is in direct contact with the fluid ingress channel. This second embodiment includes an air intake system which equalizes the pressure between the inside and outside of the fluid source by replacing the fluid dispensed out of the container with air, thus providing smoother and easier fluid flow. The air intake system also prevents contaminants from being suctioned back into the dispenser and into the medicinal supply. In a third "Spike" embodiment, the connection member includes a spike for puncturing a vile, bag or other sealed end, flexible or rigid fluid source container when that container is mounted on the spike. The third embodiment also contains an air intake system for equalizing the pressure between the inside and the outside of the fluid source container. The spike contains both the fluid ingress channel and the vent channel of the air intake system. In a fourth "Protective Cap" embodiment, a protective cap fits on the connection member and covers a fluid source container that is attached to the connection member. A sleeve may be inserted around the container to provide padding and insulation for the fluid source container. In a fifth "Adjustable Dispensing Mechanism" embodiment, the dispenser includes an adjustable dispensing mechanism for dispensing measured doses. The dispensing mechanism includes a stop member having an engagement part, and further includes at least one abutment formed on the piston member for contacting the engagement part and limiting the motion of the piston member.

The features, benefits and objects of this invention will become clear to those skilled in the art by reference to the following description, claims and drawings.

DETAILED DESCRIPTION

Figure 2:
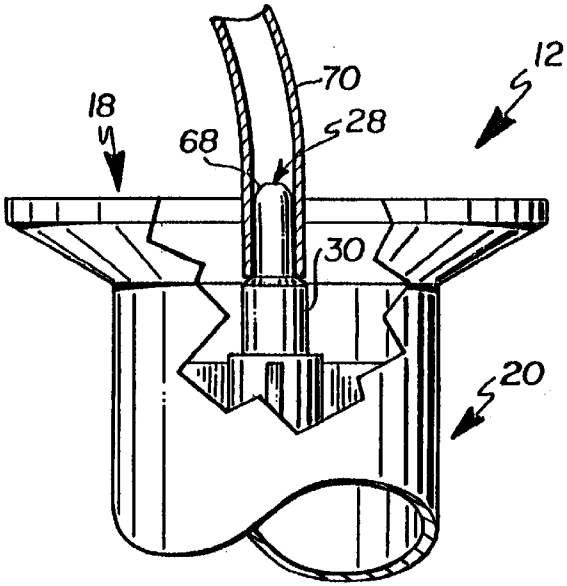
FIG. 2 is a view, partially in cross-section, of a hose attached to the fluid stem of the draw off embodiment of FIG. 1.
Figure 1:
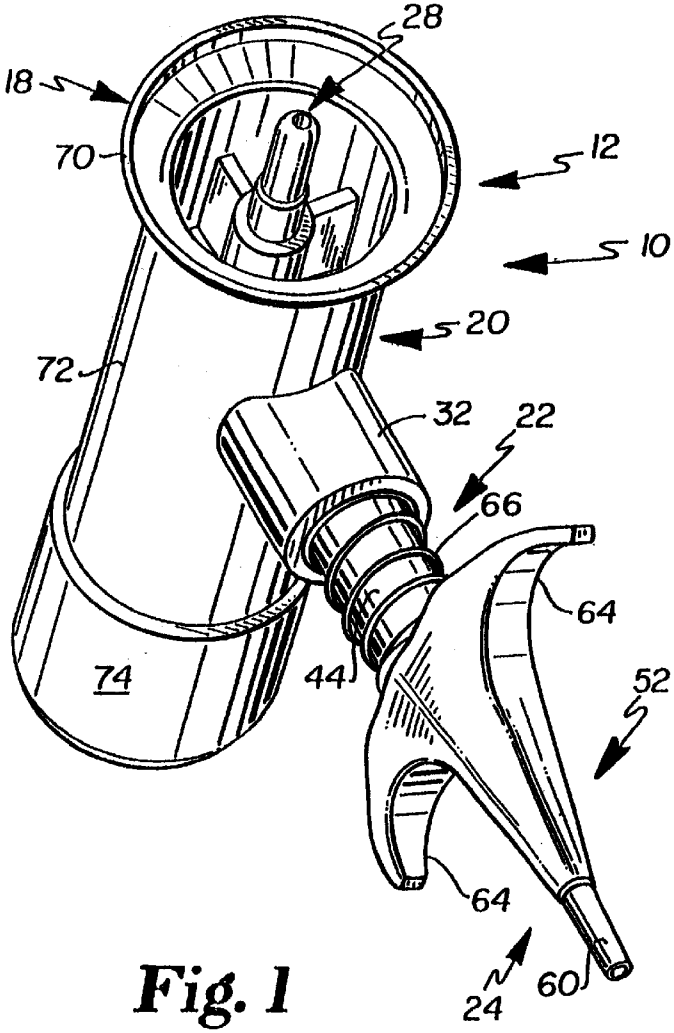
FIG. 1 is a perspective view of a draw off embodiment of the fluid dispenser apparatus of the present invention used to draw off and administer fluid from a bulk container.
Figure 9:
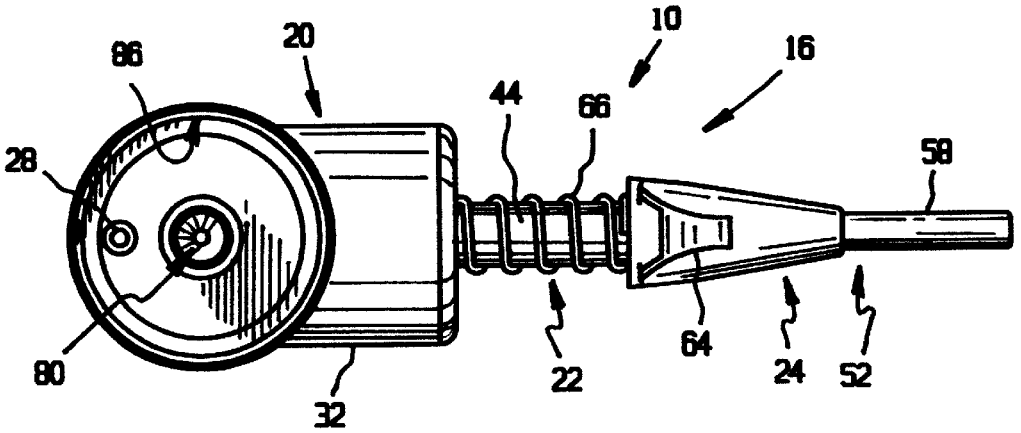
FIG. 9 is a top view of the threaded bottle mount embodiment of FIG. 7.
Figure 15:
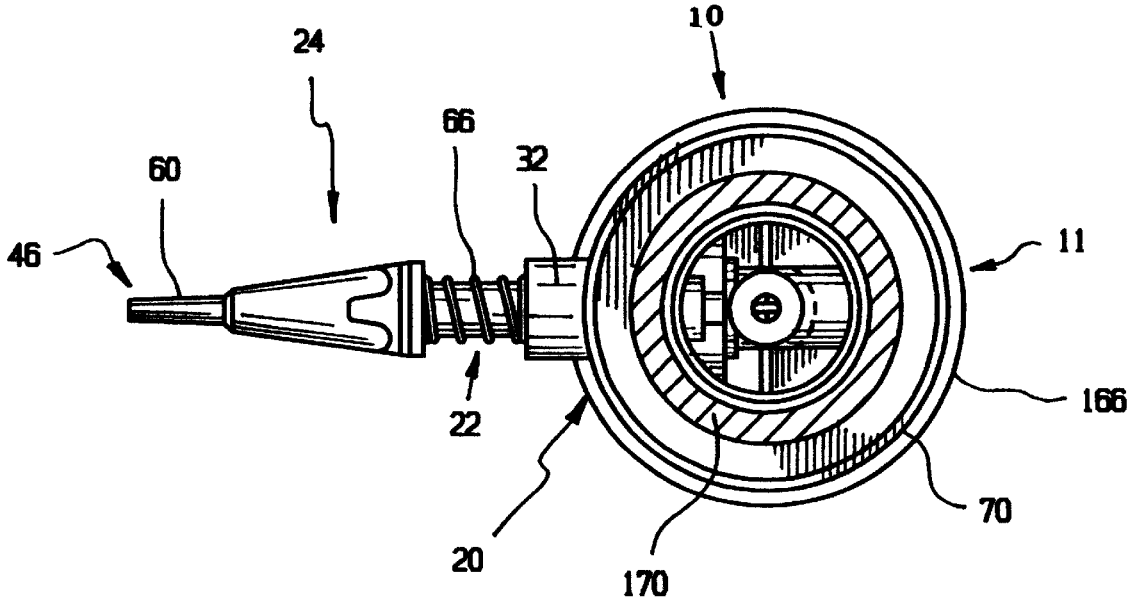
FIG. 15 is a cross-section of the protective cap embodiment taken along line 15—15 of FIG. 14.
Figure 14:
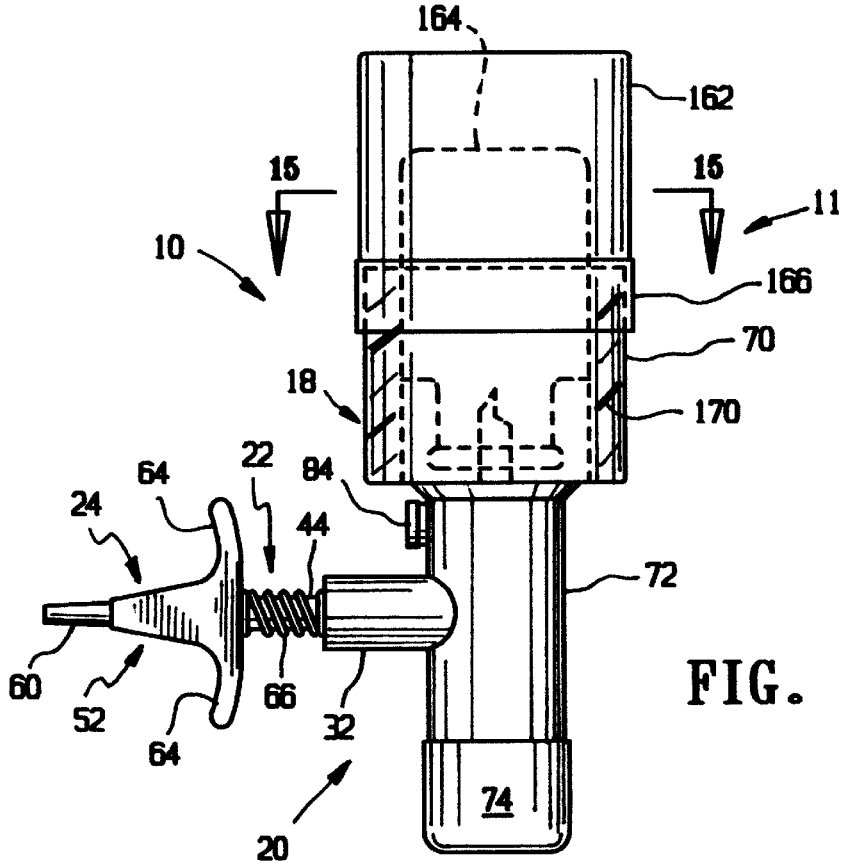
FIG. 14 is a side view of a protective cap embodiment of the fluid dispenser apparatus of the present invention.
Figure 16:
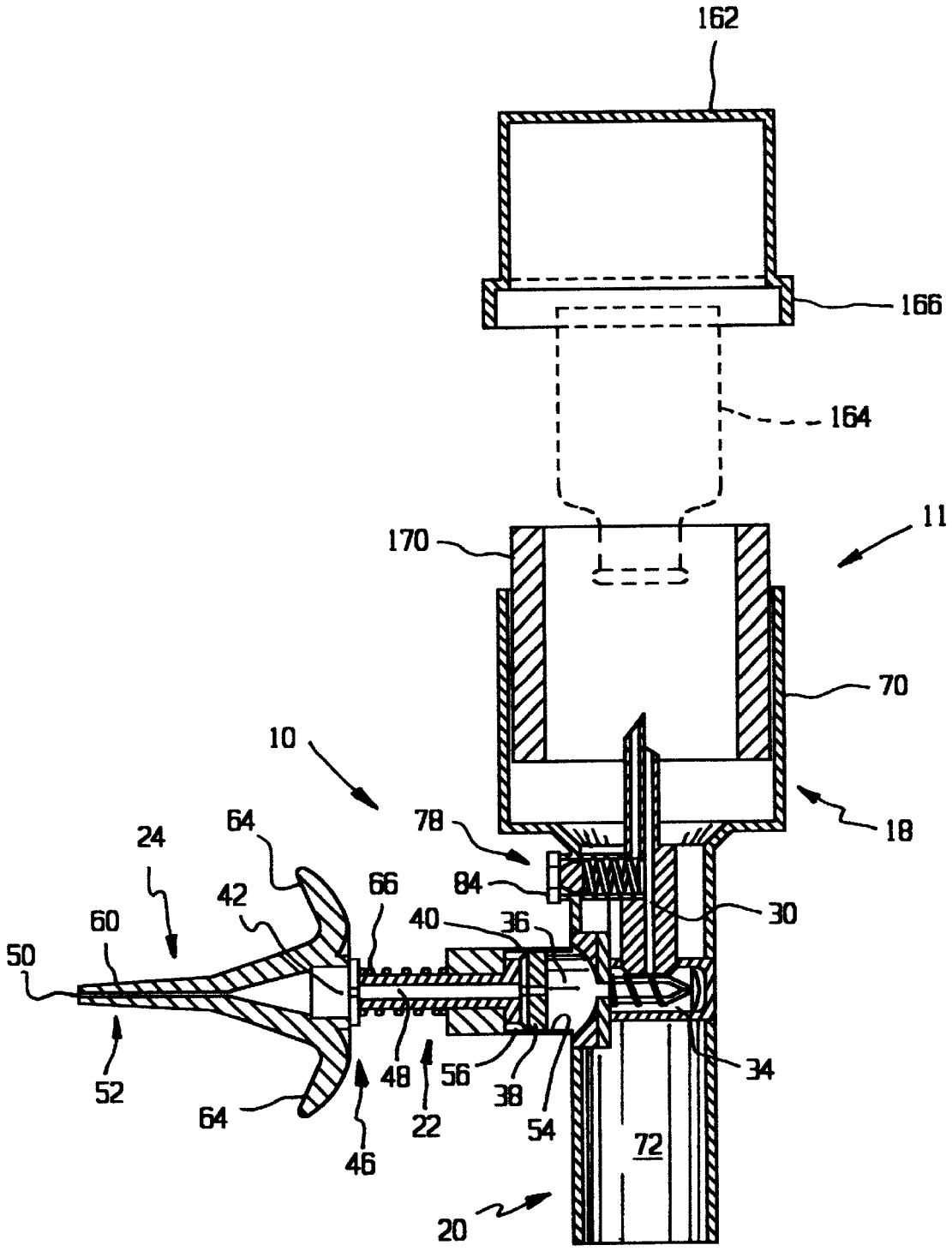
FIG. 16 is an exploded, cross-section view of the protective cap embodiment of FIG. 14.
Figure 18:
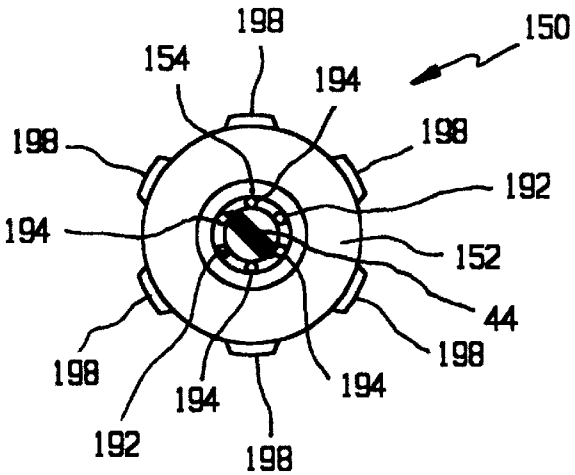
FIG. 18 is a view of the adjustable dose embodiment taken along line 18—18 of FIG. 17.
Figure 17:
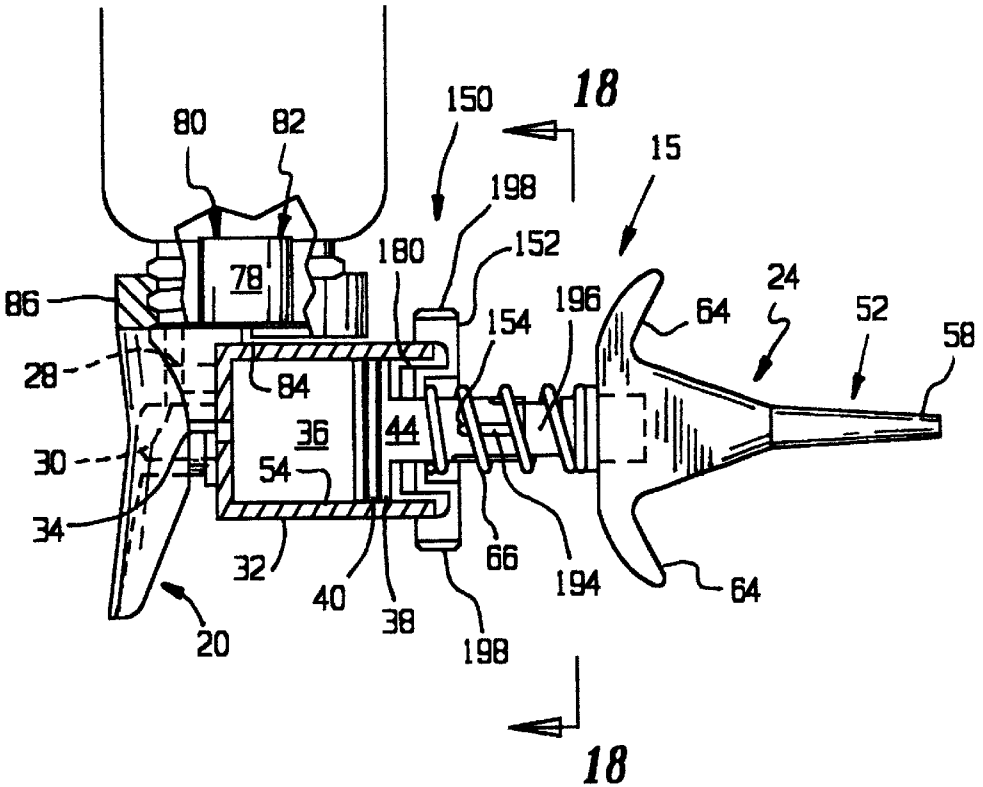
FIG. 17 is a side view, partially in cross-section, of an adjustable dispensing mechanism embodiment of the fluid dispenser of the present invention.
Figure 19:
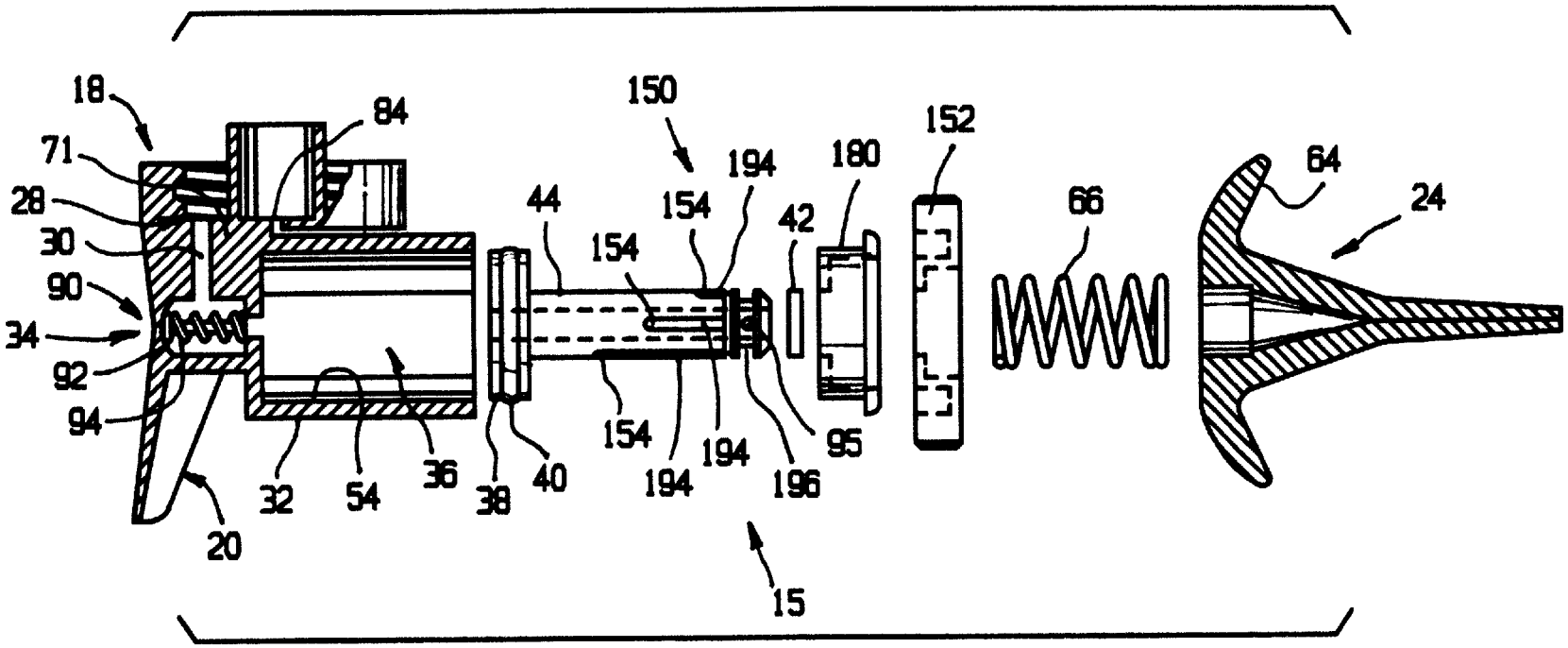
FIG. 19 is an exploded view, partially in cross-section, of the adjustable dose embodiment of FIG. 17.

FIGS. 1–11 show examples of five preferred embodiments of the dispenser apparatus 10. FIGS. 1–2 illustrate a "Draw Off" embodiment 12 of the dispenser 10, FIGS. 4–6, and 11 illustrate a "Spike" embodiment 14 of the dispenser 10, FIGS. 7–10 illustrate a "Threaded Bottle Mount" embodiment 16 of the dispenser 10, FIGS. 14–16 illustrate a "Protective Cap" embodiment 11 of the dispenser 10, and FIGS. 17–19 illustrate an "Adjustable Dispensing Mechanism" embodiment 15 of the dispenser 10. The dispenser 10 of all five embodiments is described below first in terms of its major structural elements and then in terms of its secondary structural and/or functional elements which cooperate to economically and ergonomically dispense fixed doses of fluid accurately and rapidly. The differences for each embodiment will be described in detail after the general discussion of the dispenser 10.

As generally shown in FIGS. 1, 4, 7, 10–11 the dispenser 10 includes a connection member 18, a body member 20, a piston member 22, and a trigger member 24. The connection member 18 provides fluid communication between the dispenser 10 and a fluid source or fluid source container 26. The connection member 18 is constructed to have a fluid ingress channel 28 through which the fluid flows from fluid source container 26 and into the body member 20.

Figure 10:
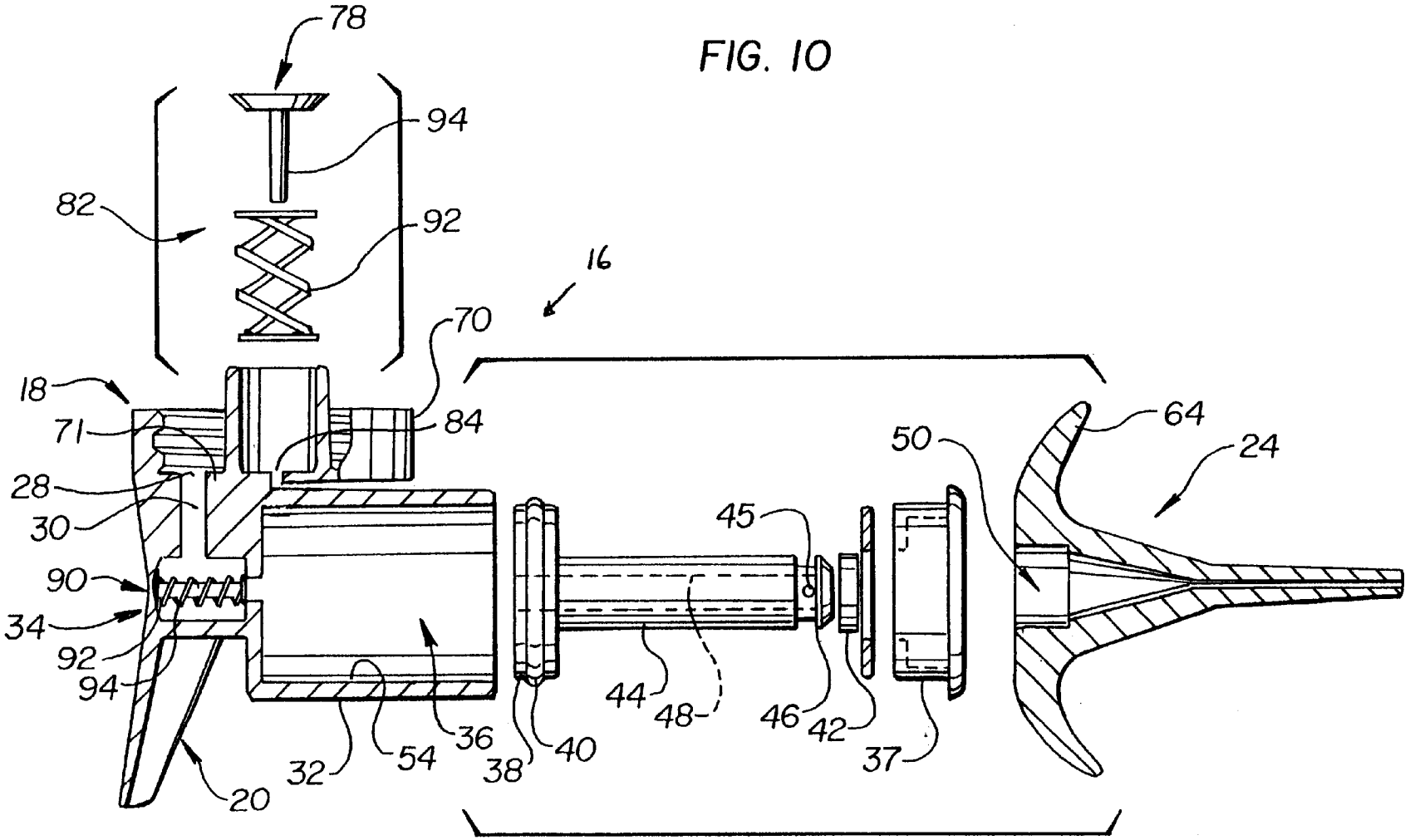
FIG. 10 is a side view, partially exploded and partially in cross-section for clarity, of the threaded bottle mount embodiment of FIG. 7.
Figure 11:
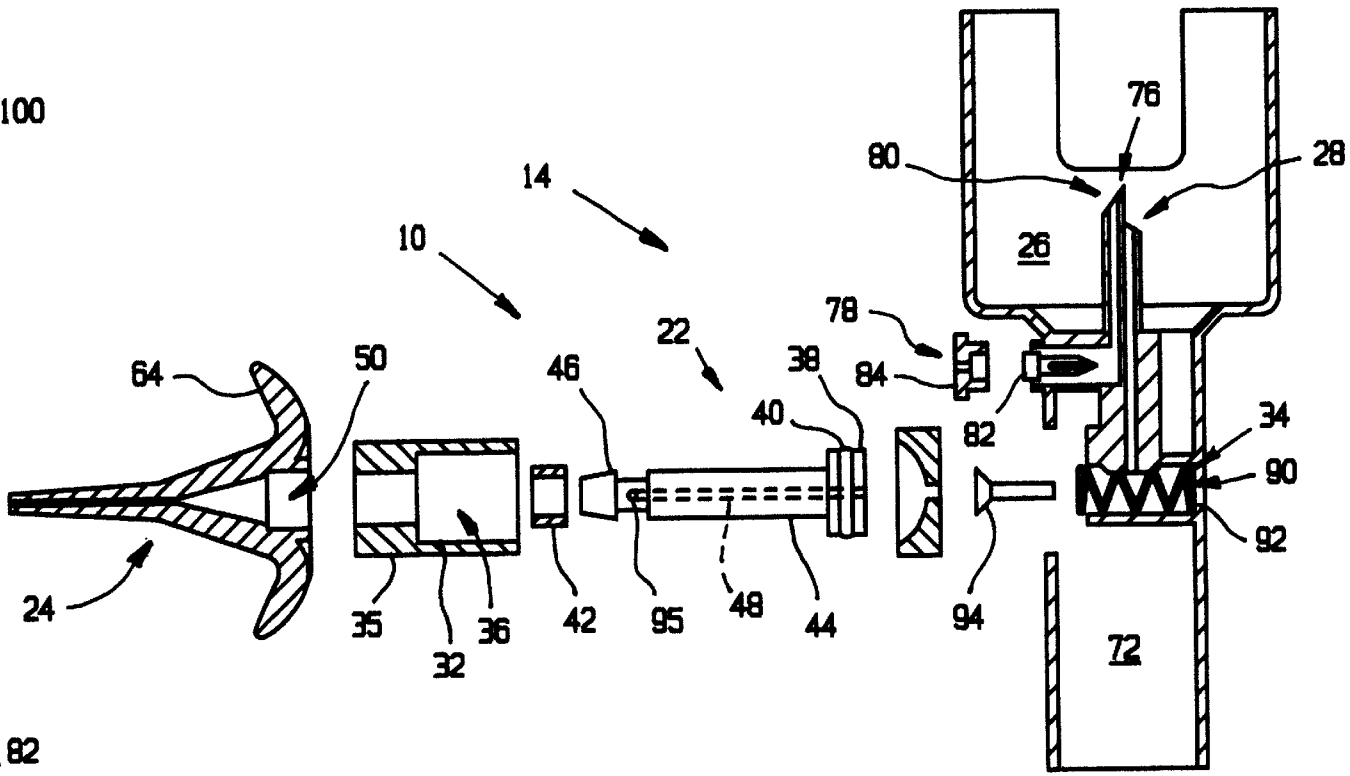
FIG. 11 is a side view, partially exploded and partially in cross-section for clarity, of the spike embodiment of FIG. 5.

The body member 20 is constructed to have a fluid communication channel 30, a dose cylinder 32, and a dose valve 34. The fluid communication channel 30 is communicatively connected to the fluid ingress channel 28 and to the dose cylinder 32 so that fluid flows from the fluid ingress channel, through the fluid communication channel 30, and into the dose cylinder 32. The dose cylinder 32 forms a cylinder for the compression and expansion stroke of the piston member 22. The dose cylinder 32 and piston member 22 are related to each other in such a way as to have a predetermined volume 36 or swept volume that corresponds to the desired dose of the dispensed fluid. As shown in FIGS. 10–11 this volume 36 may be varied by varying the width of the shoulder 35 integrally formed in the dose cylinder 32. Alternatively, it may be varied by interchanging the removable block 37 with one with a different width. Furthermore, a removable piston member 22 could be replaced with a piston member 22 that provides a different swept volume. Additionally, an adjustable dispensing mechanism 150 may be used to accurately dispense measured doses. For example, as shown in FIGS. 17–19, the adjustable dispenser mechanism 150 may include a stop member 152 having an engagement part, and may further include at least one abutment 154 formed on the piston member 22. The abutment 154 contacts the engagement part of the stop member 152 and limits the motion of the piston member 22.

Figure 6:
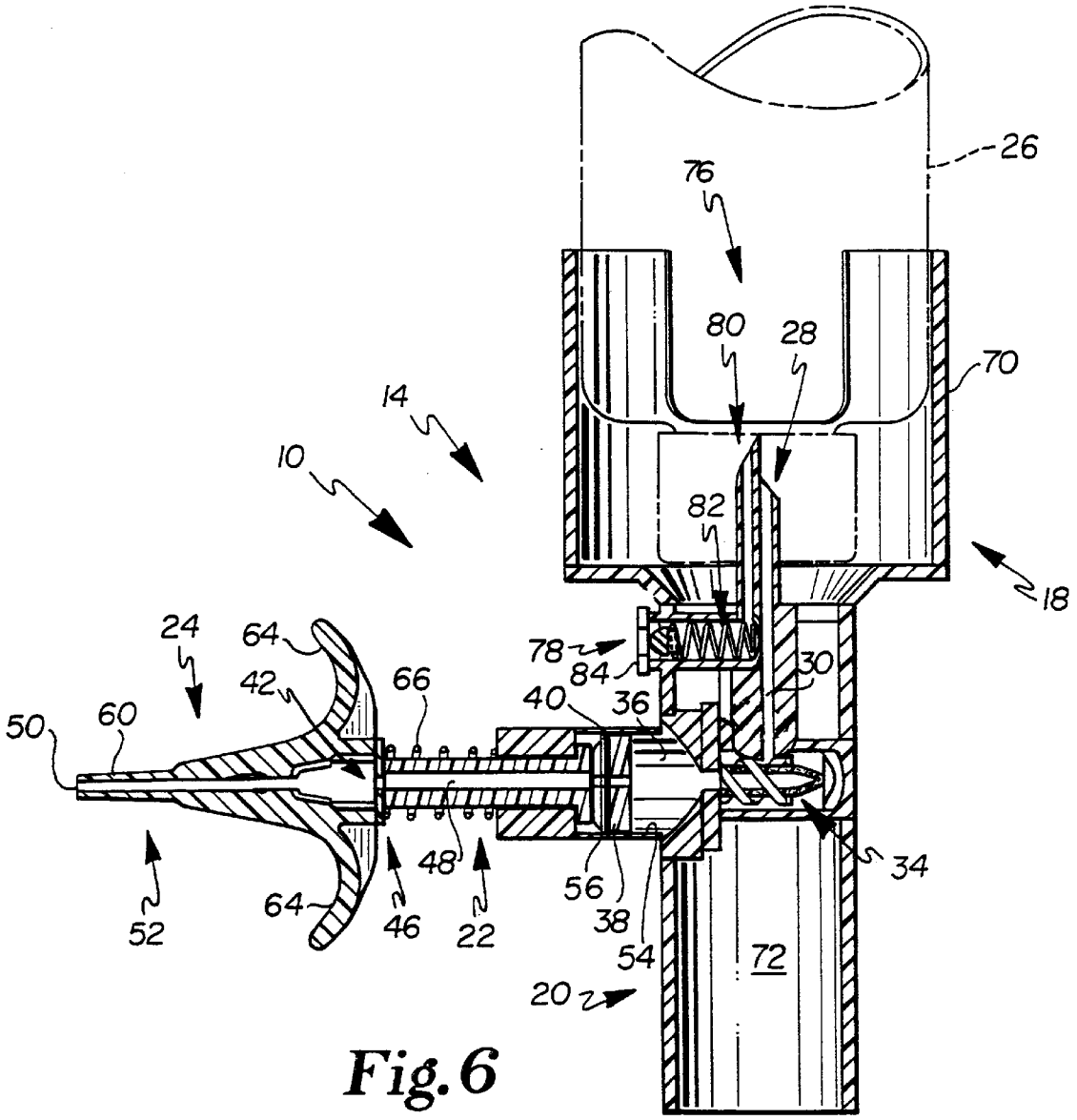
FIG. 6 is a cross section of the spike embodiment taken along line 6—6 of FIG. 5.

As shown in FIGS. 6, 10–11 the dose valve 34 is positioned between the fluid communication channel 30 and the dose cylinder 32. The dose valve 34 permits fluid to flow only in the direction from the fluid communication channel 30 to the dose cylinder 32 when the expansion stroke of the piston member 22 causes a pressure differential between the fluid communication channel 30 and the dose cylinder 32, but will not permit fluid to flow from the dose cylinder 32 to the communication channel 30 during the compression stroke of the piston member. As shown in greater detail in FIGS. 10 and 11, a one-way helix valve 90 is used as the dose valve 34. The helix valve 90 includes a helical portion 92 that fits within the fluid communication channel 30 and a valve stem 94 moveably positioned within the helical portion 92 such that it will form a seal when the pressure in the dose cylinder 32 is greater than the pressure in the communication channel 30. It is anticipated that other pressure-sensitive, one-way valves could be used as the dose valve 34.

Figures 7, 8:
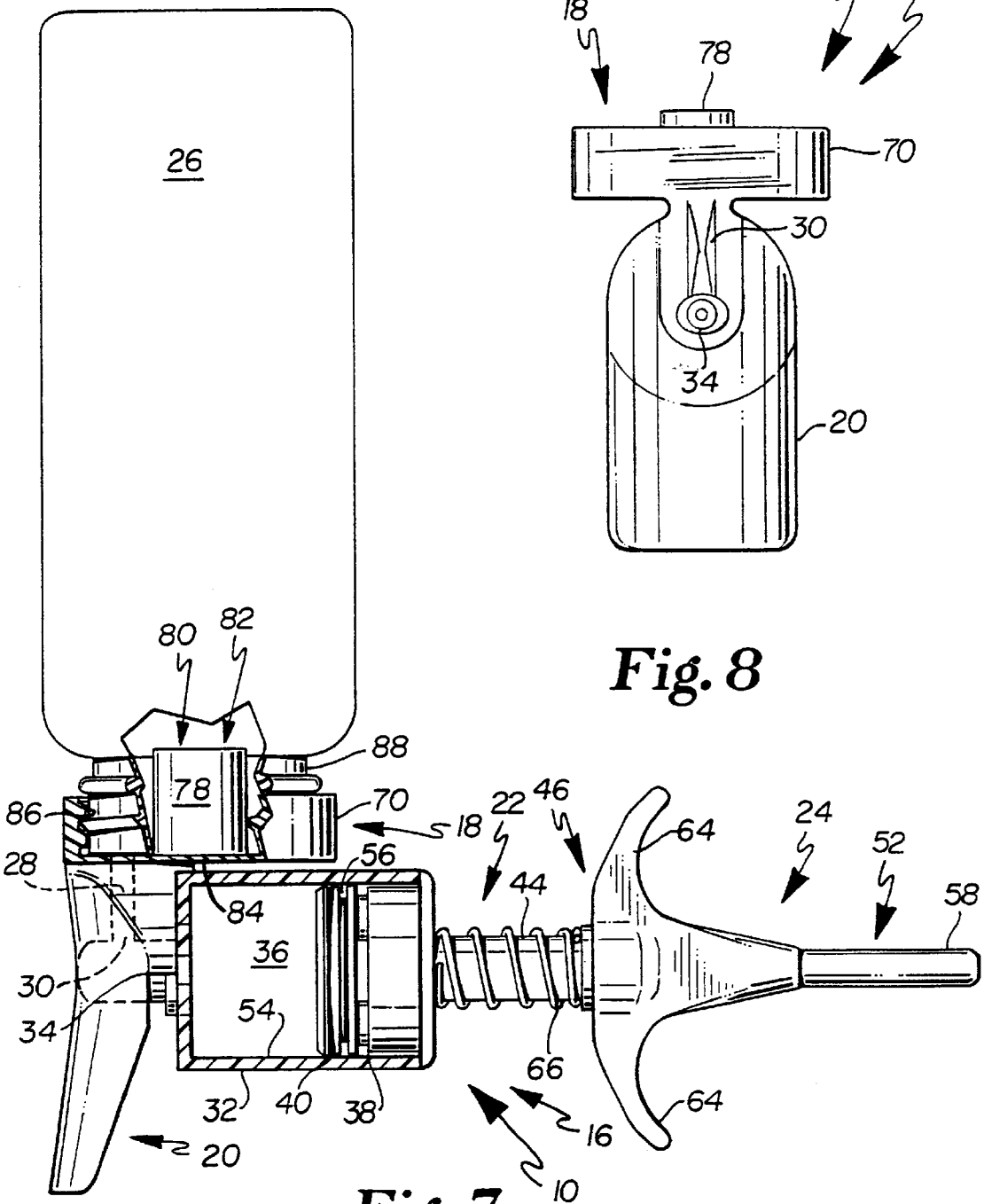
FIG. 7 is a side view, partially in cross-section, of a threaded bottle mount embodiment of the fluid dispenser apparatus of the present invention used to administer liquid from a wide-mouth threaded container.
FIG. 8 is a rear view of the threaded bottle mount embodiment of FIG. 7.

As shown in FIGS. 6 and 7, the piston member 22 generally includes a piston head 38, an annular gasket 40, a piston valve 42, and a piston rod 44. A fluid egress channel 48 extends through the piston head 38 and piston rod 44 to a distal end 46 of the piston rod 44. The piston head 38 has an outer periphery sized and shaped to have a functionally sealing fit with the interior surface 54 of the dose cylinder 32. The piston head has a circumferential groove 56 about its outer periphery sized to receive the annular gasket 40. The gasket 40 provides the functionally sealing fit with the interior surface 54 of the dose cylinder 32. The piston valve 42 is positioned at the distal end 46 of the piston member 22. As shown in more detail in FIGS. 10 and 11, the piston valve 42 has a form of an elastomeric band that provides a one-way seal around the outlet ports 95 of the fluid egress channel 48. The piston valve 42 permits fluid to only flow out of the fluid egress channel 48 when the compression stroke of the piston member 22 increases the pressure in the fluid egress channel 48. The piston member 22 or plunger provides a non-conventional delivery system for the fluid. Whereas conventional syringes expel fluid through their barrel end, the present invention expels fluid through the piston member 22.

The trigger member 24 is attached to the distal end 48 of the piston rod 44. A nozzle channel 50 within the trigger member 24 is communicatively attached to the fluid egress channel 46 and extends through the nozzle portion 52 of the trigger member 24. As required by the pharmaceutical dispensing application, the nozzle portion 52 of any of the embodiments may have the form of an oral tip 58 for oral or intranasal applications, or it may take the form of an injectable tip 60, such as a Luer slip or Luer lock tip, that can be fitted with a needle 62 for injectable applications. The body member 20 may also include a needle storage holder or storage container 72. The trigger member 24 is formed with grips 64 that interface with an operator's fingers when the body member 20 is placed in the operator's palm. An operator squeezes his or her fingers to pull the trigger member 24 toward the body member 20. This action compresses the piston member 22 within the dose cylinder 32 and expels the dose volume of the fluid through the fluid egress channel 48, the piston valve 42, the nozzle channel 50, and out of the nozzle portion 52.

A spring 66 surrounds the piston rod 44 and extends between the trigger member 24 and the dose cylinder 34. The spring 66 biases the piston member 22 in an extended position and, upon the operator's release of the trigger member 24, will automatically produce the expansion stroke by returning the piston member 22 to the extended position. The expansion stroke draws the dose volume of fluid into the dose cylinder 32.

The figures show the piston member 22 and the trigger member 24 extending from the body member 20 at a near right angle. However, the piston member 22 and trigger member 24 could be aligned with the body member 20 such that it is in the general location of the shown position for the storage container 72.

Many elements of the dispenser 10 preferably are manufactured from a clear or relatively transparent plastic material. The body member and connection member are generally molded as a unitary piece of plastic, as is the piston member. This material provides a strong, light weight and inexpensive dispenser 10. Furthermore, the transparent nature of the material allows an operator to visually monitor the device in operation. The dispenser 10 is manufactured to be easily cleaned, sanitized and lubricated. However, it is also inexpensive enough to be considered semi-disposable; that is, it can be disposed after an application or a series of applications as warranted by the circumstances.

Figure 3:
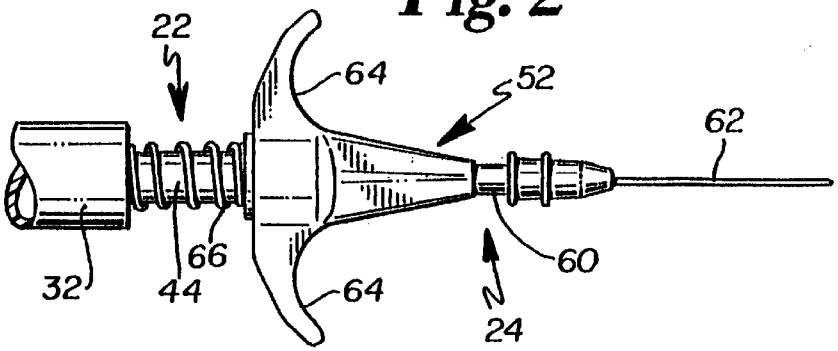
FIG. 3 is a side view of a needle attached to a trigger member.

The Draw Off embodiment 12 shown in FIG. 1 has an injectable tip 60 for receiving a needle 62 as shown in FIG. 3. The body member 20 is constructed to have a storage container 72 designed to store spare and/or used needles. The storage container 72 is closed with a removable cap 74, plug or other closure. The Draw Off embodiment 12 is designed to dispense fluid from flexible or rigid bulk fluid source containers of various sizes and shapes. The connection member 18 is constructed with a fluid stem 68 that contains the fluid ingress channel 28. The fluid stem 68 is designed to receive a hose 70 that provides a communicative path between the external fluid source container and the fluid ingress channel 28. The connection member 18 also has continuous side walls 70, which in this embodiment are flange-like.

Figure 4:
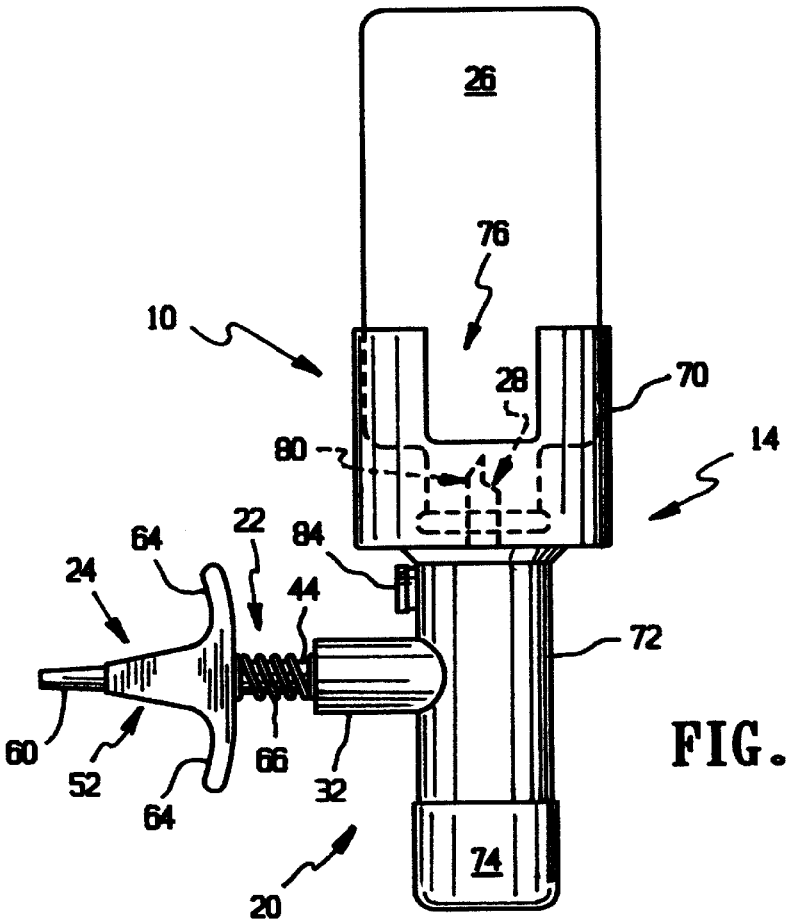
FIG. 4 is a side view of a spike embodiment of the fluid dispenser apparatus of the present invention used to administer fluid from a sealed end pharmaceutical bottle.
Figure 5:
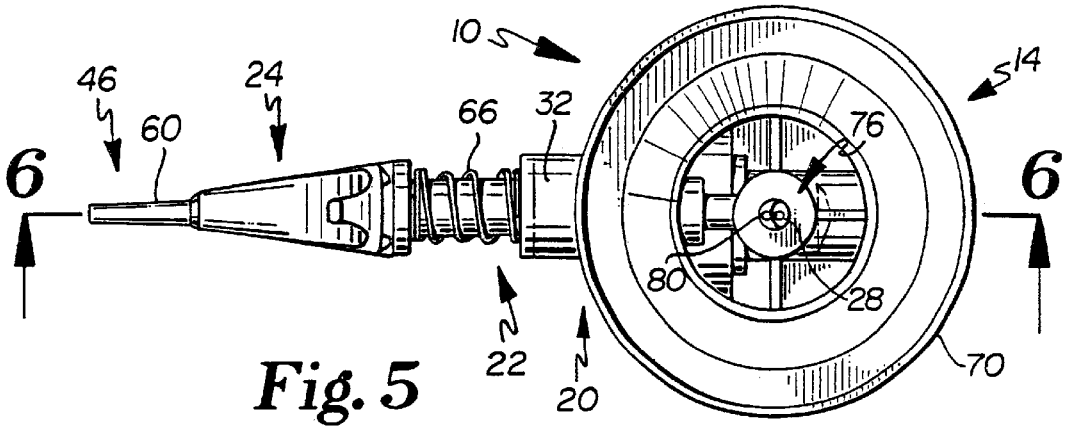
FIG. 5 is a top view of the spike embodiment of FIG. 4.
Figure 20:
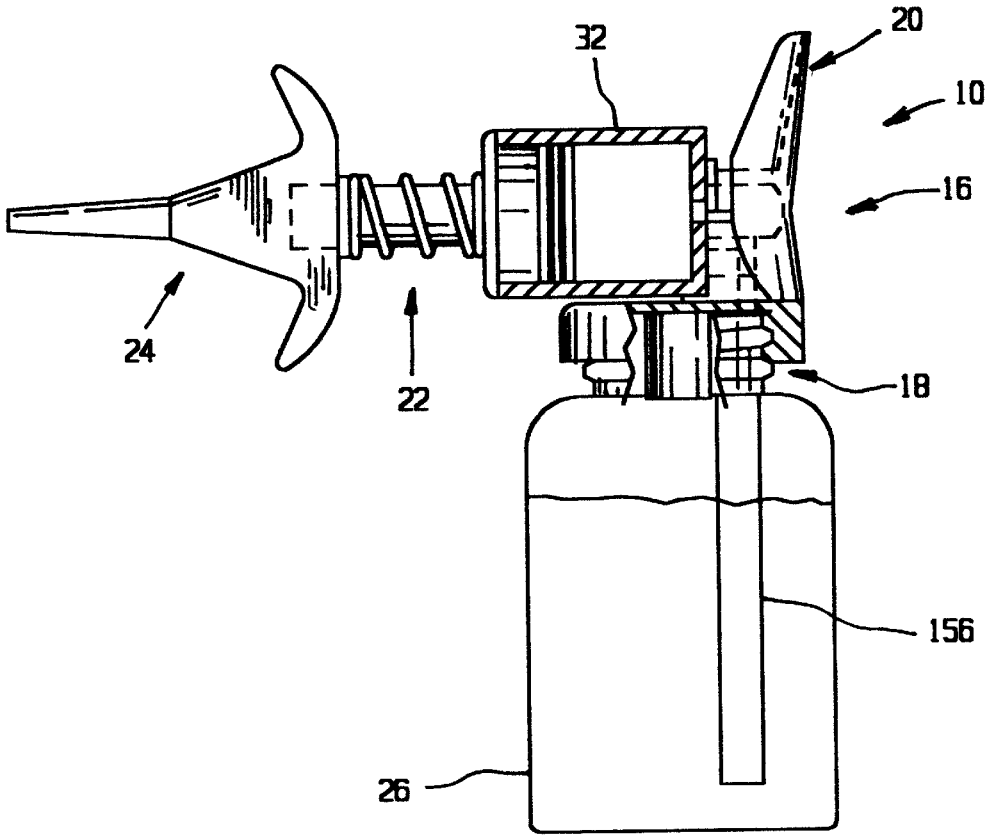
FIG. 20 is a side view, partially in cross-section, of an inverted threaded bottle mount embodiment of the fluid dispenser apparatus of the present invention.

The Spike embodiment 14 shown in FIGS. 4–6 is shown to have an injectable tip 60 for receiving a needle 62 as shown in FIG. 3. The body member 20 is constructed to have a storage container 72 designed to store spare and/or used needles. The storage container 72 is closed with a removable cap 74, plug or other closure. The Spike embodiment 14 is designed to directly mount a vile or other sealed end fluid source container 26 onto the dispenser 10. The connection member 18 is constructed with a spike 76 designed to puncture through the sealed end of a flexible or rigid fluid source container 26, and with a continuous side wall 70 designed to support the fluid source container 26 in a mounted position. The Spike embodiment includes an air intake system 78 that replaces fluid drawn from the fluid source container 26 with ambient air as an automatic venting function. The air intake system 78 provides for smoother fluid flow and easier operation by equalizing the pressure between the interior and exterior of the fluid source container 26. The air intake system 78 generally comprises a vent channel 80, an air valve 82, and an air intake port 84. The vent channel 80 provides the means for transferring ambient air from the air intake port 84, through the air valve 82, and into the fluid source container 26. A pressure differential is created between the outside and inside of the container 26 when fluid is dispensed. The air valve 82 allows air to enter the container 26 when there is a pressure differential, and it prevents fluid from flowing out of the container 26 the vent channel 80. The spike 76 contains both the fluid ingress channel 28 and the vent channel 80. The spike 76 may be formed to extend and remain in fluid communication with the contents of the fluid source container 26 if the dispenser 10 is used in an inverted position, as generally illustrated in FIG. 20.

Figure 12:
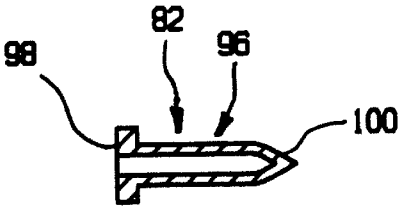
FIG. 12 is a side view of the elastomeric valve used as the air valve in FIG. 11.
Figure 13:
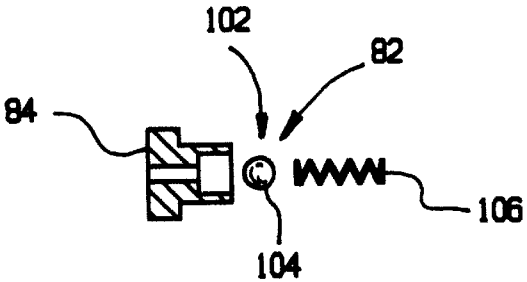
FIG. 13 is a side view of a check valve that could alternatively be used as the air valve in FIG. 11.

As shown in FIGS. 11, 12 and 13, the air valve 82 may use different types of one-way pressure sensitive valves. FIGS. 11 and 12 show an air valve 82 that uses a wedge-like, elastomeric valve 96. The elastomeric valve 96 has a generally cylindrical shaped proximate end 98 and a distal end 100. The distal end 100 has a slit that is normally closed, thus preventing fluid from flowing out the air intake system 78, but opens relatively easily to allow air to flow into the container 26. Alternatively as shown in FIG. 13, a check valve 102 containing a check ball 104 and spring 106 could be use to provide the one-way valve function.

The Threaded Bottle Mount embodiment 16 shown in FIGS. 7–10 has an oral tip 58. This embodiment is designed to directly attach a bottle or fluid source container 26 onto the dispenser 10 by screwing it onto the connection member 18. The connection member 18 is constructed to have a form similar to an inverted bottle cap, including continuous side walls 70 having interiorly disposed threads 86 designed to mate with exteriorly disposed threads 88 on the container 26, such as a wide mouth threaded container. The connection member 18 has a bottom surface 71 disposed between and joined to the side walls 70. FIG. 10 shows the connection member 18 exploded as a separate element for clarity. However, the connection member 18 is typically molded with the body member 20 as a unitary piece. The fluid ingress channel 28 is formed by an aperture in the bottom surface 71. The Threaded Bottle Mount embodiment includes an air intake system 78 that replaces fluid drawn from the fluid source container 26 with ambient air as an automatic venting function. The air intake system 78 provides for smoother fluid flow easier operation by equalizing the pressure between the interior and exterior of the fluid source container 26, which prevents the fluid from being suctioned back into the container 26 and possibly contaminating the medicinal source. The air intake system 78 generally comprises a vent channel 80, an air valve 82, and an air intake port 84. The vent channel 80 provides the means for transferring ambient air from the air intake port 84, through the air valve 82, and into the fluid source container 26. A pressure differential is created between the inside and outside of the container 26 when fluid is dispensed. The air valve 82 allows air to enter the container 26 when there is a pressure differential, but it prevents fluid from flowing out of the container 26 through the vent channel 80. The air valve 82 shown in FIG. 10 is a helix valve 90 that contains a helical portion 92 and a valve stem 94. It is anticipated that other one-way, pressure sensitive valves could be used. The connection member 18 is constructed to contain the vent channel 80. The bottle mount embodiment shown in FIG. 7 does not have a "stem" extending between the dose cylinder 32 and the fluid source container 26. Rather gravity pulls the contents of the fluid source container 26 over the fluid ingress channel aperture and, upon an expansion stroke, into the dose cylinder 32. FIG. 20 illustrates an inverted bottle mount embodiment. The fluid is drawn up into the dose cylinder 32 through an extended stem 156 upon each expansion stroke.

The protective cap embodiment 11 include a protective cap 162 sized to fit on the connection member 18 and cover the fluid source container 26, such as a closed end pharmaceutical bottle 164 as shown in FIGS. 14 and 16. The protective cap 162 has a margin 166 that has a slightly greater diameter than the diameter of the continuous wall 70. The margin 166 is sized to promote a secure fit between the protective cap 162 and the connection member 18 and to promote quick and easy removal and reattachment of the protective cap 162 to the connection member 18. The protective cap 162 is preferably formed from polyethylene, polypropylene, or another hard plastic which provides protection against accidental breakage of the fluid source container 26. A sleeve 170, preferably made of foam rubber, may be inserted within the continuous wall 70 and the protective cap 162. The sleeve 170 surrounds the fluid source container 26. The sponge-like sleeve 170 provides additional protection or cushion against accidental breakage of the fluid source container 26. Additionally, the sleeve 170 insulates the contents of the fluid source container 26 from the environment in order to keep cool contents cool and warm contents warm.

Referring to FIGS. 17–19, the adjustable dispensing mechanism embodiment 15 includes an adjustable dispensing mechanism 150 for dispensing measured doses. The dispensing mechanism 150 is designed to limit the motion of the piston member 22 within the dose cylinder 32. A stop member 152 is attached to the dispenser 10 in a predetermined position with respect to the dose cylinder 32. The piston member 22 is formed with a plurality of abutments 154 spaced axially around the piston rod 44. At least one projection or engagement part 192 extending from the stop member 152 relates or contacts with these abutments 154. The abutments 154 are preferably formed from predetermined arrangement of a plurality of grooves 194 formed in the surface of the piston rod 44. Preferably, the grooves 194 extend longitudinally along the plunger and are axially spaced around the circumference of the piston rod 44. Furthermore, it is preferable that a first end of the grooves are circumferencially aligned along the plunger at a point corresponding to the completion of a compression stroke. The respective end walls at the second end of each of the grooves form the abutments. A circumferencial groove 196 preferably intersects each of the longitudinal grooves 194 at a point so that the projection 192 extends into the circumferencial groove 196 when the piston rod 44 has completed a compression stroke. Each of the differently-sized longitudinal grooves 194 extend away from the circumferencial groove 196. The projection 192 fits within the grooves 194 and 196, tracks within the longitudinal grooves 194 during the compression and expansion strokes, and tracks from one longitudinal groove to another through the circumferencial groove 196.

During an expansion stroke, the piston rod 44 will move until the projection 192 contacts the end wall or abutment 154 for that groove. Therefore, the length of a longitudinal groove 196 determines the movement of the piston rod 44, and thus corresponds to a predetermined volume of fluid that is drawn into the dose 32 cylinder during an expansion stroke. During the compression stroke, the piston member 22 expels the predetermined volume of fluid from the dose 32 cylinder. After the compression stroke, the projection 192 is in alignment with the circumferencial groove 196, allowing the piston member 22 and projection 192 to be rotated with respect to each other until the projection 192 aligns with the longitudinal groove 194 that corresponds to a new desired dose volume. Alternatively, rather than using a circumferencial groove 196, the projection 192 could be retracted out of a longitudinal groove, realigned with another longitudinal groove, and reinserted. Another alternative is to have a plurality of retractable projections prealigned with the longitudinal grooves, wherein a desired dose volume is selected by inserting a projection into the desired groove. The stop member 152 shown in FIGS. 17–19 has two diametrically-opposed projections or engagement parts 192. Similarly, the piston rod 44 has sets of grooves, wherein each set is comprised of two diametrically-opposed grooves of equal length. The diametrically-opposed projections 192 evenly distribute the biasing force and prevents the piston member 22 from becoming skewed within the dose cylinder 32.

The stop member 152 forms an annular cap having an aperture sized to permit the plunger to slidingly fit within the cap and is sized to fit over an edge of the dose cylinder 32. The stop member 152 and its projection 192 are preferably rotatable on the edge. The stop member 152 may be held in place using the spring 66 as shown in FIGS. 17 and 19, or alternatively the stop member 152 may be rotatably coupled to the dose cylinder 32. If the stop member 152 is affixed to the dose cylinder 32, the piston member 22 should be rotatable. A scale or other markings 198 correlating to the dose volume for an aligned groove could be provided on the dose cylinder 32 and stop member 152, or alternatively on the piston rod 44 and stop member 152. A plug 180 fits within the dose cylinder 32. The piston rod 44 slides within an aperture of the plug 180. The plug 180 preferably has projections that fit within the longest set of longitudinal grooves 194, which corresponds to the longest stroke that can be selected by a user. The projections within the plug 180 prevent the piston member 22 from rotating within the dose cylinder 32. The stop member 152 is rotatable about the plug 180 and the dose cylinder 32 when the projection 192 is within the circumferencial groove 196 of the piston. A user limits the stroke of the piston member 22 by rotating the stop member 152 until its projection(s) align with shorter longitudinal grooves 194. The piston member 22, the plug 180 and the stop member 152 are all easily removed from and reattached to the dose cylinder 32.

In the embodiment shown in FIGS. 17–19, the circumferencial groove 196 intersects each of the longitudinal grooves 194 near the base of the trigger member 24. The projection 192 of the stop member 152 tracks from one longitudinal groove to another via the circumferencial groove 196. Thus the dose volume drawn into the cylinder can be adjusted by squeezing the trigger member completely so that the projection enters the circumferencial groove, aligning the projection with a desired groove using the scale 198, and releasing the trigger member until the projection contacts the corresponding abutment.

Figure 21:
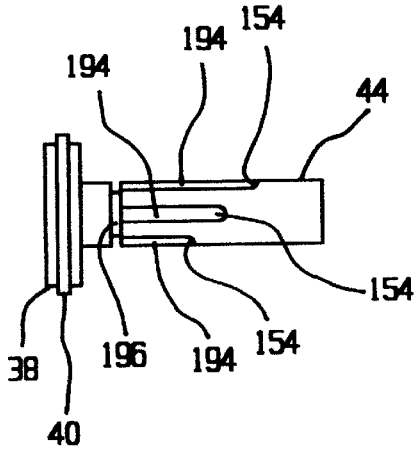
FIG. 21 is a side view of an alternative piston member for the adjustable dispensing mechanism embodiment of the fluid dispenser of the present invention.

Alternatively, as illustrated in FIG. 21, the circumferencial groove 196 may intersect each of the longitudinal grooves 194 corresponding to the place on the piston rod 44 proximate to the projection 192 when the piston member 22 has undergone a completed expansion stroke. The projection 192 extends inwardly from the stop member 152 and limits the compression stroke of the piston member 22, depending on the particular groove 194 in which the projection 192 has entered. Thus, this embodiment can be used to meter desired volumes of material from pre-filled dispenser. Cough syrup, for example, may be metered or dispensed in this manner. The length of each groove 194 corresponds to an incremental increase in the volume dispensed. In operation, the projection 192 is initially aligned with the shortest groove and the piston member 22 is pushed into the dose cylinder 32 to distribute the first desired volume interval. The piston member 22 is then retracted back to its original position where the projection 192 is aligned with the circumferencial groove 196. The piston member 22 is then rotated so that a longer groove 194 is aligned with the projection 192. The piston member 22 is then pushed into the dose cylinder 32 an incremental amount further than the first time, which distributes a second desired volume interval. This process can be repeated until the dispenser is empty.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A fluid dispenser, comprising:

(a) a body member having a fluid communication channel and a dose cylinder of a predetermined volume, said fluid communication channel being communicatively connected with said dose cylinder;

(b) a fluid egress conduit communicatively connected to said dose cylinder;

(c) a dose valve positioned and arranged to govern fluid flow from said fluid communication channel to said dose cylinder;

(d) a piston valve positioned and arranged to govern fluid flow out of said fluid egress conduit;

(e) a piston member having a piston head, a distal end and a piston rod connecting said piston head to said distal end, said piston head being sealingly disposed within said dose cylinder;

(f) a trigger member attached to said distal end of said piston member; and (g) a dispensing mechanism positioned and arranged to dispense measured doses out of said fluid egress conduit, said dispensing mechanism including:

(i) a stop member having an engagement part; and (ii) at least one abutment formed on said piston member for contacting said engagement part and for limiting motion of said piston member, and wherein said piston rod has a cylindrically-shaped surface, said at least one abutment comprising a plurality of abutments circumferentially spaced around and staggered lengthwise on said piston rod surface, each of said plurality of abutments corresponding to a predetermined range of longitudinal movement by said piston member.

2. The fluid dispenser of claim 1, wherein said trigger member includes at least one grip for contact with at least one finger of a user and further includes a nozzle portion and a nozzle channel communicatively connected to said fluid egress conduit, whereby said body member is adapted to rest in a user's palm and a user's finger squeezes said grip toward said body member to provide force for said compression stroke of said piston member.

3. The fluid dispenser of claim 1, wherein said piston member has a fluid egress channel that forms said fluid egress conduit and extends through said piston head and said piston rod to said distal end.

4. The fluid dispenser of claim 1, wherein said piston member is biased in an extended position by a spring, said spring being positioned around said piston member and in between said trigger member and said dose cylinder, whereby said spring provides force for said expansion stroke of said piston member.

5. The fluid dispenser of claim 1, wherein said piston head has a circumference, a groove formed around said circumference, and an annular gasket placed within said groove, said gasket providing said fit within said dose cylinder, said piston member being easily removed and reinstalled into said dose cylinder to promote cleaning.

6. The fluid dispenser of claim 1, wherein said stop member has an annular shape and said piston rod extends through said stop member, said engagement part being a projection extending radially inward from said stop member.

7. The fluid dispenser of claim 1, wherein said stop member moves relative with respect to said piston member, said relative movement including longitude movement and rotational movement.

8. The fluid dispenser of claim 7, wherein said piston member is non-rotatable with respect to said dose cylinder and said stop member is rotatable with respect to said dose cylinder.

9. The fluid dispenser of claim 1, wherein each of said at least one abutment comprises an end wall of a longitudinal groove formed on said piston rod, said engagement part fitting and tracking within said at least one longitudinal groove during expansion and compression strokes of said piston member.

10. The fluid dispenser of claim 9, wherein said piston rod is further formed with a circumferencial groove intersecting said at least one longitudinal groove, wherein relative rotational motion between said stop member and said plunger is effected when said engagement part is disposed within said circumferencial groove.

11. The fluid dispenser of claim 10, wherein said circumferencial groove intersects said at least one longitudinal groove at a point on said piston rod so that said engagement part enters said circumferencial groove when said piston member is fully compressed.

12. The fluid dispenser of claim 1, wherein said dispensing mechanism further includes a scale for indicating a dose volume corresponding to each of said at least one abutments.

13. The fluid dispenser of claim 1, further comprising a connection member having a fluid ingress channel communicatively connected to a fluid source container and to said fluid communication channel, said fluid source container having an interior and an exterior.

14. The fluid dispenser of claim 13, where in said connection member has a continuous side wall, said continuous side wall having a predetermined size and shape for receiving and supporting said fluid source container.

15. The fluid dispenser of claim 14, wherein said connection member has a continuous side wall and a bottom surface joined with said side wall, said continuous side wall having interior threads, said fluid source container having external threads, said fluid source container being connected to said connection member by mating said interior threads with said external threads, said bottom surface having an aperture which forms said fluid ingress channel.

16. The fluid dispenser of claim 14, further comprising a protective cap sized to fit on said connection member and cover said fluid source container.

17. The fluid dispenser of claim 16, wherein said protective cap has a margin sized and adapted to fit over said continuous side wall.

18. The fluid dispenser of claim 16, further comprising a sleeve positioned within said continuous side wall, said fluid source container being received within said sleeve, said protective cap covering said sleeve and said fluid source container, said sleeve providing insulation and padding for said fluid source container.

19. The fluid dispenser of claim 14, further comprising insulation and padding for said fluid source container.

20. The fluid dispenser of claim 19, wherein said insulation and said padding are provided by a foam rubber sleeve positioned within said continuous side wall and said protective cap.

21. The fluid dispenser of claim 13, wherein said connection member has a fluid stem, said fluid ingress channel being contained within said fluid stem.

22. The fluid dispenser of claim 21, wherein said fluid stem is formed to receive a hose for drawing fluid from said fluid source container, said hose being communicatively connected between said fluid source container and said fluid stem.

23. The fluid dispenser of claim 21, wherein said fluid stem is a spike designed to penetrate said fluid source container when said fluid source container is directly mounted onto said spike.

24. The fluid dispenser of claim 23, further including an air intake system to equalize pressure between the interior and the exterior of said fluid source container when fluid is drawn out of said fluid source container, said air intake system including an air intake port, a vent channel communicatively connected from said air intake port to said fluid source, and an air valve designed to allow ambient air to flow through said vent channel into said fluid source container upon a pressure differential between the interior and the exterior of said fluid source container and to prevent fluid from flowing out of said fluid source container through said vent channel, wherein said spike further includes a vent channel.

25. The fluid dispenser of claim 21, wherein fluid source container is positioned below said dose cylinder, said fluid stem extending into said fluid source container to draw fluid up into said fluid ingress channel and said dose cylinder.

26. The fluid dispenser of claim 13, wherein said fluid source container is positioned above said dose cylinder and wherein gravity pulls fluid from said fluid source container into said fluid ingress channel and said dose cylinder.

27. The fluid dispenser of claim 13, further including an air intake system to equalize pressure between the interior and the exterior of said fluid source container when fluid is drawn out of said fluid source container.

28. The fluid dispenser of claim 27, wherein said air intake system includes an air intake port, a vent channel communicatively connected from said air intake port to said fluid source, and an air valve designed to allow ambient air to flow through said vent channel into said fluid source container upon a pressure differential between the exterior and the interior of said fluid source container and to prevent fluid from flowing out of said fluid source container through said vent channel.

29. A fluid dispenser, comprising:

(a) a body member having a fluid communication channel and a dose cylinder of a predetermined volume, said fluid communication channel being communicatively joined with said dose cylinder;

(b) a fluid egress conduit communicatively connected to said dose cylinder;

(c) a dose valve positioned and arranged to govern fluid flow from said fluid communication channel to said dose cylinder;

(d) a piston valve positioned and arranged to govern fluid flow out of said fluid egress conduit;

(e) a piston member having a piston head, a distal end, a piston rod connecting said piston head to said distal end, and a fluid egress channel communicatively connected to said dose cylinder, said fluid egress channel extending through said piston head and said piston rod to said distal end, said fluid egress channel forming said fluid egress conduit, said piston head being sealingly fit within said dose cylinder;

(f) a trigger member attached to said distal end of said piston member, said trigger member having a nozzle portion and a nozzle channel communicatively connected to said fluid egress channel, said nozzle portion extending through said nozzle portion;

(g) a connection member having a fluid ingress channel communicatively connected to a fluid source container and to said fluid communication channel; and (h) a dispensing mechanism for dispensing measured doses out of said fluid egress conduit, said dispensing mechanism including a stop member having an engagement part, and further including at least one abutment formed on said piston member for contacting said engagement part and for limiting motion of said piston member, each of said at least one abutment comprising an end wall of a longitudinal groove formed on said piston rod, said engagement part fitting and tracking within said at least one longitudinal groove during expansion and compression strokes of said piston member, said piston rod having a circumferencial groove intersecting said at least one longitudinal groove, wherein relative rotational motion between said stop member and said piston member is effected when said engagement part is within said circumferencial groove.

30. A fluid dispenser, comprising:

(a) a connection member having a fluid stem constructed to receive a hose, said fluid stem containing a fluid ingress channel communicatively connected to a fluid source container through said hose, said fluid source container having an interior and an exterior;

(b) a body member having a fluid communication channel, a dose cylinder of a predetermined volume, and a dose valve, said fluid communication channel being communicatively joined with said fluid ingress channel and said dose cylinder, said dose valve being positioned between said fluid communication channel and said dose cylinder, said dose valve governing fluid flow from said fluid communication channel to said dose cylinder, said body member further having a storage container sized to store a plurality of needles, said storage container having a closure;

(c) a piston member having a piston head, a distal end, a piston valve, and a fluid egress channel communicatively connected to said dose cylinder, said fluid egress channel extending through said piston head and said piston rod to said distal end, said piston head having a circumference, a groove formed around said circumference, an annular gasket placed within said groove to form a sealing fit within said dose cylinder, said piston valve being positioned and arranged to govern fluid flow out of said fluid egress channel, said piston member being biased in an extended position by a spring, said spring being positioned around said piston member; and (d) a trigger member attached to said distal end of said piston member, said trigger member having a nozzle channel communicatively connected to said fluid egress channel, said trigger member including at least one grip formed to interface with at least one finger, said spring being positioned in between said trigger member and said dose cylinder.

31. A fluid dispenser, comprising:

(a) a body member having a fluid communication channel and a dose cylinder of a predetermined volume, said fluid communication channel being communicatively connected with said dose cylinder;

(b) a fluid egress conduit communicatively connected to said dose cylinder;

(c) a dose valve positioned and arranged to govern fluid flow from said fluid communication channel to said dose cylinder;

(d) a piston valve positioned and arranged to govern fluid flow out of said fluid egress conduit;

(e) a piston member having a piston head, a distal end and a piston rod connecting said piston head to said distal end, said piston head being sealingly disposed within said dose cylinder;

(f) a trigger member attached to said distal end of said piston member; and (g) a dispensing mechanism positioned and arranged to dispense measured doses out of said fluid egress conduit, said dispensing mechanism including:

(i) a stop member having an engagement part; and (ii) at least one abutment formed on said piston member for contacting said engagement part and for limiting motion of said piston member, wherein said at least one abutment comprises an end wall of a longitudinal groove formed on said piston rod, said engagement part fitting and tracking within said at least one longitudinal groove during expansion and compression strokes of said piston member.

* * * * *